US011006742B2

(12) United States Patent
Jeanne et al.

(10) Patent No.: US 11,006,742 B2
(45) Date of Patent: May 18, 2021

(54) METHOD AND SYSTEM FOR A ACHIEVING OPTIMAL ORAL HYGIENE BY MEANS OF FEEDBACK

(71) Applicant: KONINKLIJKE PHILIPS N.V., Eindhoven (NL)

(72) Inventors: Vincent Jeanne, Mignes Auxances (FR); Aleksandro Grabulov, Bellevue, WA (US); Sarah Michaux, Kirkland, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 231 days.

(21) Appl. No.: 16/078,405

(22) PCT Filed: Feb. 20, 2017

(86) PCT No.: PCT/IB2017/050941

§ 371 (c)(1),
(2) Date: Aug. 21, 2018

(87) PCT Pub. No.: WO2017/145033

PCT Pub. Date: Aug. 31, 2017

(65) Prior Publication Data

US 2019/0045916 A1 Feb. 14, 2019

Related U.S. Application Data

(60) Provisional application No. 62/350,906, filed on Jun. 16, 2016, provisional application No. 62/299,635, filed on Feb. 25, 2016.

(51) Int. Cl.
*A46B 15/00* (2006.01)

(52) U.S. Cl.
CPC ..... *A46B 15/0008* (2013.01); *A46B 15/0006* (2013.01); *A46B 15/0012* (2013.01); *A46B 15/0038* (2013.01); *A46B 2200/1066* (2013.01)

(58) Field of Classification Search
CPC ..... A46B 15/0008; A46B 15/0006; A46B 15/0012; A46B 15/0038; A46B 2200/1066
See application file for complete search history.

(56) References Cited

U.S. PATENT DOCUMENTS 6,536,068 B1 * 3/2003 Yang ..... A46B 15/0002 15/105
8,172,574 B2 * 5/2012 Hilfinger ..... A46B 15/0002 15/167.1
8,337,213 B2 * 12/2012 Puurunen ..... A46B 15/0006 434/263
8,789,227 B2 * 7/2014 Cook ..... A46B 15/0002 15/22.1

(Continued)

*Primary Examiner* — Weilun Lo

(57) ABSTRACT

An oral cleaning system (100, 200) configured to provide optimal oral cleaning using an oral cleaning device (10), the system capable of receiving, extracting, and assessing data from one or more sensors (28) of the oral cleaning device to determine whether optimal cleaning has been achieved during a primary oral cleaning session, and if not, generating a customized secondary cleaning routine configured to achieve optimized cleaning session. The customized secondary cleaning routine is offered to the user, and the system guides the user through the customized secondary cleaning routine to achieve optimal cleaning performance.

15 Claims, 7 Drawing Sheets

(56) References Cited

U.S. PATENT DOCUMENTS

| | | | | |
|---|---|---|---|---|
| 8,863,343 | B2 * | 10/2014 | Iwahori | A61C 17/221 15/22.1 |
| 9,105,197 | B2 * | 8/2015 | Meriheinae | A46B 15/0002 |
| 2009/0092955 | A1 | 4/2009 | Hwang | |
| 2009/0215015 | A1 * | 8/2009 | Chu | A46B 15/0006 434/238 |
| 2010/0024143 | A1 * | 2/2010 | Dickie | A46B 15/0087 15/167.1 |
| 2011/0010876 | A1 | 1/2011 | Iwahori | |
| 2012/0251971 | A1 | 10/2012 | Fish et al. | |
| 2015/0044629 | A1 * | 2/2015 | Wang | A46B 15/0006 433/27 |
| 2015/0230593 | A1 | 8/2015 | Doll et al. | |
| 2015/0302770 | A1 | 10/2015 | Meriheinae et al. | |
| 2015/0313353 | A1 * | 11/2015 | Schmalhurst | A46B 15/0044 15/22.1 |
| 2016/0143718 | A1 * | 5/2016 | Serval | A46B 15/0008 15/22.1 |
| 2019/0008270 | A1 * | 1/2019 | Hardeman | G09B 19/0084 |
| 2019/0008619 | A1 * | 1/2019 | Jeanne | G09B 5/04 |

* cited by examiner

METHOD AND SYSTEM FOR A ACHIEVING OPTIMAL ORAL HYGIENE BY MEANS OF FEEDBACK

CROSS-REFERENCE TO PRIOR APPLICATIONS

This application is the U.S. National Phase application under 35 U.S.C. § 371 of International Application No. PCT/IB2017/050941, filed on Feb. 20, 2017, which claims the benefit of U.S. Provisional Patent Application No. 62/350,906, filed on Jun. 16, 2016 and U.S. Provisional Patent Application No. 62/299,635 filed on Feb. 25, 2016. These applications are hereby incorporated by reference herein.

FIELD OF THE INVENTION

The present disclosure is directed generally to methods and systems for providing feedback about a cleaning session to a user of an oral cleaning device.

BACKGROUND

Proper tooth brushing, including length and coverage of brushing, helps ensure long-term dental health. Many dental problems are experienced by individuals who either do not regularly brush their teeth or who do so inadequately, especially in a particular area or region of the oral cavity. Among individuals who do brush regularly, improper brushing habits can result in poor coverage of brushing and thus surfaces that are not adequately cleaned during a cleaning session, even when a standard brushing regimen, such as brushing for two minutes twice daily, is followed.

To facilitate proper brushing, it is important to ensure that there is adequate cleaning of all dental surfaces, including areas of the mouth that are hard to reach or that tend to be improperly cleaned during an average cleaning session. One way to ensure adequate coverage is to track the position of the toothbrush in the mouth during a cleaning session and compare that to a map of the dental surfaces. For example, a system with sensors positioned in fixed relationship to the teeth of the user could track the movement of a toothbrush over the user's teeth. Alternatively, the toothbrush could include one or more internal sensors that attempt to track movement of the device within the mouth. In such a system, the user starts with the toothbrush at a known, fixed position within the mouth and subsequent movement of the brush is determined from the one or more internal sensors.

However, this approach has several limitations. First, in order to be effective, the system must be able to adequately identify and track the regions of the mouth being brushed, which is challenging due to significant oral variation within a population. Second, while existing methods and devices may guide or direct a user's brushing activity during a timed cleaning session, the methods and devices are not able to detect the quality of the brushing activity during that cleaning session. Further, even if an inadequate cleaning session is detected, existing methods and devices are unable to correct the detected inadequacy.

Accordingly, there is a continued need in the art for methods and devices that provide feedback to a user based on an analysis of brushing data obtained during a cleaning session in order to detect and correct a cleaning session deficiency.

SUMMARY OF THE INVENTION

The present disclosure is directed to inventive methods and systems for providing feedback about a cleaning session to a user of an oral cleaning device. Applied to a system configured to provide a guided cleaning session, the inventive methods and systems enable tracking of a cleaning session and thus enable a detailed evaluation of the coverage and quality of a cleaning session. When the evaluation identifies inadequacies in the user's cleaning session or technique the system conveys that information to the user, and includes instructions for remedying the inadequacies. The instructions can include, for example, information about which regions of the mouth to brush and for how long. Accordingly, the system utilizes sensor data to monitor the cleaning session and detect areas where brushing is not optimal, and then guides the user through a secondary cleaning session that ensures an optimal brushing performance in all areas of the mouth.

Generally in one aspect, a method for providing feedback to a user of an oral cleaning device is provided. The method includes the steps of: receiving, from a sensor of the oral cleaning device, sensor data during a primary cleaning session; extracting, from the received data, information about one or more parameters of the primary cleaning session and evaluating, based on the extracted information, the primary cleaning session; determining, based on said evaluation, whether a secondary cleaning session is needed; and providing, via a user interface, an indication to the user that a secondary cleaning session is needed.

According to an embodiment, the one or more parameters is selected from the group consisting of the duration of the primary cleaning session, pressure applied during the primary cleaning session, the location of the oral cleaning device within the mouth during the primary cleaning session, an angle of the oral cleaning device during the primary cleaning session, and combinations thereof.

According to an embodiment, the determining step comprises the step of comparing the extracted information to a predetermined threshold.

According to an embodiment, the evaluation comprises an analysis of the extracted information using a set of one or more rules.

According to an embodiment, the indication comprises information about one or more segments of the user's mouth that requires additional cleaning during the secondary cleaning session, and/or an amount of additional cleaning time required for the one or more segments of the user's mouth that requires additional cleaning.

According to an embodiment, the method further includes the step of providing real-time feedback about the cleaning session to the user during the primary and/or secondary cleaning session.

According to an embodiment, the method further includes the step of receiving, from the sensor of the oral cleaning device, sensor data during the secondary cleaning session.

According to an aspect is an oral cleaning device configured to provide feedback to a user about a cleaning session. The device includes: a sensor configured to obtain data regarding a brushing session; a user interface configured to provide feedback to the user about the brushing session; and a controller in communication with the sensor and the user interface, wherein the controller is configured to: receive, from the sensor, sensor data during a primary cleaning session; extract, from the received data, information about one or more parameters of the primary cleaning session and evaluate, based on the extracted information, the primary cleaning session; determine, based on said evaluation, whether a secondary cleaning session is needed; and provide, via the user interface, an indication to the user that a secondary cleaning session is needed.

According to an embodiment, the sensor is one or more of a gyroscope, an accelerometer, and a magnetometer.

According to an aspect is an oral cleaning system configured to provide feedback to a user about a cleaning session. The system includes: an oral cleaning device comprising a sensor configured to obtain sensor data regarding a brushing session, and a connectivity module configured to transmit the obtained sensor data; and a remote device comprising a communications module configured to receive the transmitted sensor data, and a processor configured to: extract, from the received data, information about one or more parameters of the primary cleaning session and evaluate, based on the extracted information, the primary cleaning session; determine, based on said evaluation, whether a secondary cleaning session is needed; and provide an indication to the user that a secondary cleaning session is needed.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method and device for providing feedback about a cleaning session to a user of an oral cleaning device. More generally, Applicant has recognized and appreciated that it would be beneficial to provide a system to track the movement of an oral cleaning device within the mouth in order to evaluate a user's cleaning session and provide feedback for a secondary cleaning session. Accordingly, the methods described or otherwise envisioned herein provide an oral cleaning device configured to evaluate a user's cleaning session, determine how long or how well the user brushes regions of the mouth among other variables, and provide information about a secondary cleaning session to the user. According to an embodiment, the oral cleaning device comprises one or more sensors to obtain data utilized to evaluate the user's cleaning session, and comprises a feedback mechanism to guide the user through a secondary cleaning session in order to achieve an optimal cleaning session.

The embodiments and implementations disclosed or otherwise envisioned herein can be utilized with any oral device, including but not limited to a toothbrush, a flossing device such as a Philips AirFloss®, an oral irrigator, or any other oral device. One particular goal of utilization of the embodiments and implementations herein is to provide brushing information and feedback using an oral cleaning device such as, e.g., a Philips Sonicare® toothbrush (manufactured by Koninklijke Philips Electronics, N.V.). However, the disclosure is not limited to a toothbrush and thus the disclosure and embodiments disclosed herein can encompass any oral device.

Figure 1:
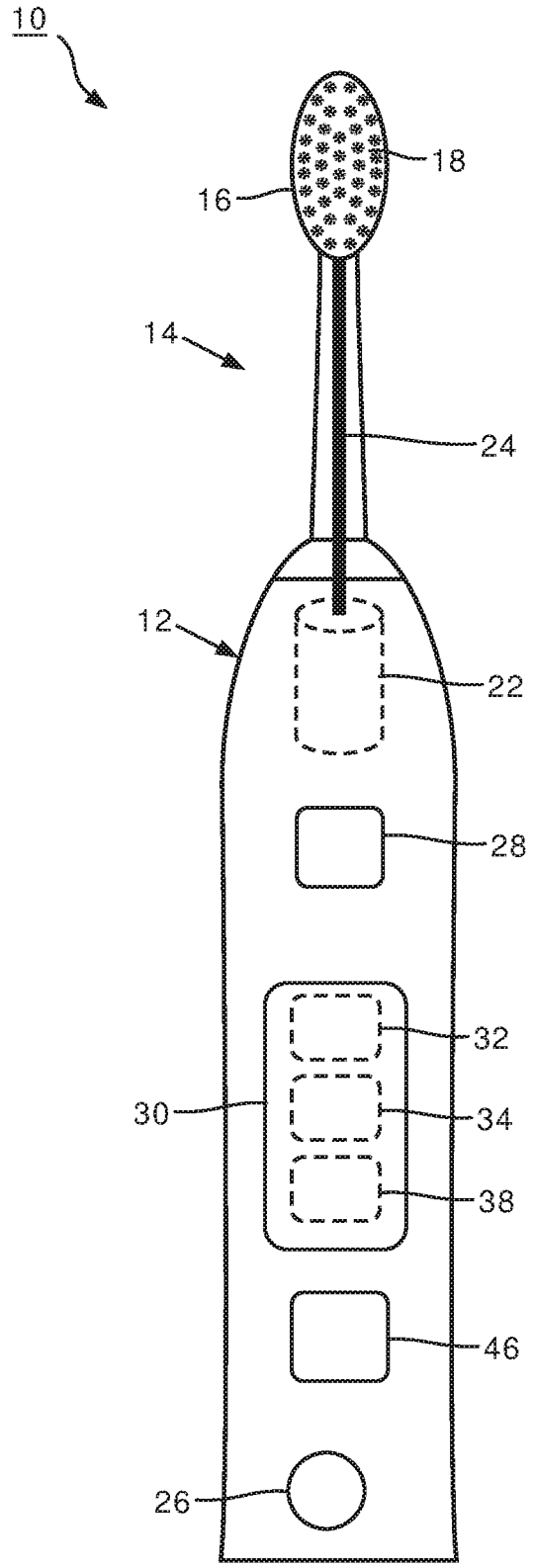
FIG. 1 is a schematic representation of an oral cleaning device, in accordance with an embodiment.

Referring to FIG. 1, in one embodiment, an oral cleaning device 10 is provided that includes a body portion 12 and a brush head member 14 mounted on the body portion. Brush head member 14 includes at its end remote from the body portion a brush head 16. Brush head 16 includes a bristle face 18, which provides a plurality of bristles. According to an embodiment, the bristles extend along an axis substantially perpendicular to the head's axis of elongation, although many other embodiments of the brush head and bristles are possible.

According to an embodiment, head member 14, brush head 16, and/or bristle face 18 are mounted so as to be able to move relative to the body portion 12. The movement can be any of a variety of different movements, including vibrations or rotation, among others. According to one embodiment, head member 14 is mounted to the body so as to be able to vibrate relative to body portion 12, or, as another example, brush head 16 is mounted to head member 14 so as to be able to vibrate relative to body portion 12. The head member 14 can be fixedly mounted onto body portion 12, or it may alternatively be detachably mounted so that head member 14 can be replaced with a new one when the bristles or another component of the device are worn out and require replacement.

According to an embodiment, body portion 12 includes a drivetrain 22 for generating movement and a transmission component 24 for transmitting the generated movements to brush head member 14. For example, drivetrain 22 can comprise a motor or electromagnet(s) that generates movement of the transmission component 24, which is subsequently transmitted to the brush head member 14. Drivetrain 22 can include components such as a power supply, an oscillator, and one or more electromagnets, among other components. In this embodiment the power supply comprises one or more rechargeable batteries, not shown, which can, for example, be electrically charged in a charging holder in which oral cleaning device 10 is placed when not in use.

Although in the present embodiment the oral cleaning device 10 is an electric toothbrush, it will be understood that in an alternative embodiment the oral cleaning device is a manual toothbrush (not shown). In such an arrangement, the manual toothbrush has electrical components, but the brush head is not mechanically actuated by an electrical component.

Body portion 12 is further provided with a user input 26 to activate and de-activate movement generator 22. The user input 26 allows a user to operate the toothbrush 20, for example to turn the toothbrush 20 on and off. The user input 26 may, for example, be a button, touch screen, or switch.

The oral cleaning device 10 includes one or more sensors 28. Sensor 28 is shown in FIG. 1 within body portion 12, but may be located anywhere within the device, including for example within brush head member 14 or brush head 16. The sensors 28 can comprise, for example, a 6-axis or a 9-axis spatial sensor system, and can include one or more of an accelerometer, a gyroscope, and/or a magnetometer to provide readings relative to axes of motion of the oral cleaning device, and to characterize the orientation and displacement of the device. For example, the sensor 28 can be configured to provide readings of six axes of relative motion (three axes translation and three axes rotation), using for example a 3-axis gyroscope and a 3-axis accelerometer. Many other configurations are possible. Other sensors may be utilized either alone or in conjunction with these sensors, including but not limited to a pressure sensor (e.g. Hall effect sensor) and other types of sensors, such as a sensor measuring electromagnetic waveforms on a predefined range of wavelengths, a capacitive sensor, a camera, a photocell, a visible light sensor, a near-infrared sensor, a radio wave sensor, and/or one or more other types of sensors. Many different types of sensors could be utilized, as described or otherwise envisioned herein. According to an embodiment, these additional sensors provide complementary information about the position of the device with respect to a user's body part, a fixed point, and/or one or more other positions. According to an embodiment, sensor 28 is disposed in a predefined position and orientation in the oral cleaning device 10, and the brush head is in a fixed spatial relative arrangement to sensor 28. Therefore, the orientation and position of the brush head can be easily determined based on the known orientation and position of the sensor 28.

According to an embodiment, sensor 28 is configured to generate information indicative of the acceleration and angular orientation of the oral cleaning device 10. For example, the sensor system may comprise two or more sensors 28 that function together as a 6-axis or a 9-axis spatial sensor system. According to another embodiment, an integrated 9-axis spatial sensor can provide space savings in an oral cleaning device 10.

The information generated by the first sensor 28 is provided to a controller 30. Controller 30 may be formed of one or multiple modules, and is configured to operate the oral cleaning device 10 in response to an input, such as input obtained via user input 26. According to an embodiment, the sensor 28 is integral to the controller 30. Controller 30 can comprise, for example, at least a processor 32, a memory 34, and a connectivity module 38. The processor 32 may take any suitable form, including but not limited to a microcontroller, multiple microcontrollers, circuitry, a single processor, or plural processors. The memory 34 can take any suitable form, including a non-volatile memory and/or RAM. The non-volatile memory may include read only memory (ROM), a hard disk drive (HDD), or a solid state drive (SSD). The memory can store, among other things, an operating system. The RANI is used by the processor for the temporary storage of data. According to an embodiment, an operating system may contain code which, when executed by controller 30, controls operation of the hardware components of oral cleaning device 10. According to an embodiment, connectivity module 38 transmits collected sensor data, and can be any module, device, or means capable of transmitting a wired or wireless signal, including but not limited to a Wi-Fi, Bluetooth, near field communication, and/or cellular module.

According to an embodiment, oral cleaning device 10 includes a user interface 46 configured to provide information to a user before, during, and/or after a primary cleaning session, and before, during, and/or after a secondary cleaning session. The user interface 46 can take many different forms, but is configured to provide information to a user. For example, the information can be read, viewed, heard, felt, and/or otherwise interpreted concerning where, when, and/or how to brush particular sections, segments, or areas of the interior of the mouth. According to an embodiment, the user interface 46 provides feedback to the user, such as a guided cleaning session, that includes information about where within the mouth to brush, timing, angles, pressure, and/or a variety of other brushing parameters or characteristics. Accordingly, the user interface may be a display that provides information to the user, a haptic mechanism that provides haptic feedback to the user, a speaker to provide sounds or words to the user, or any of a variety of other user interface mechanisms. According to an embodiment, controller 30 of oral cleaning device 10 receives information from sensor 28, assesses and analyzes that information, and provides information that can be displayed to the user via the user interface 46.

Figure 2:
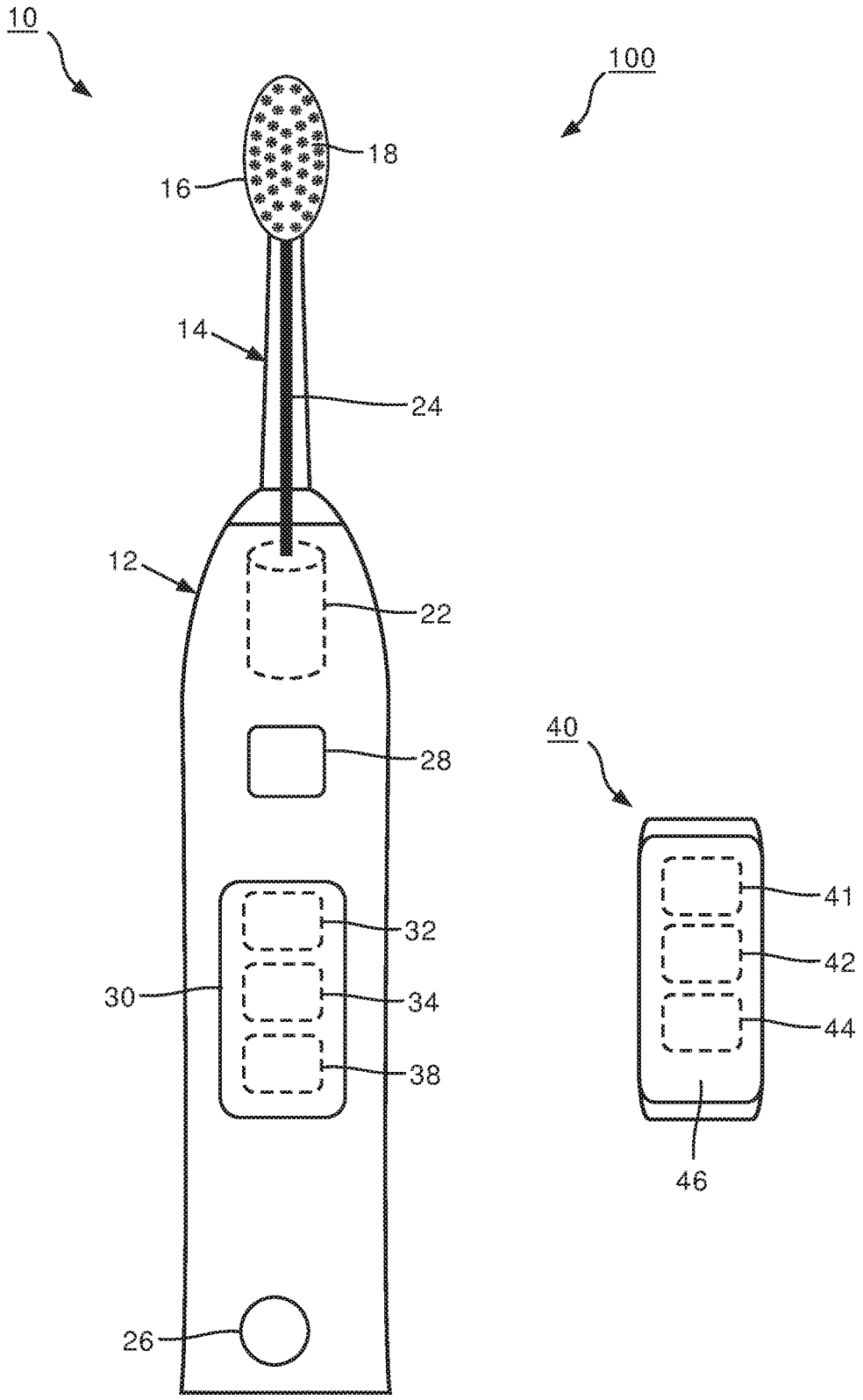
FIG. 2 is a schematic representation of an oral cleaning system, in accordance with an embodiment.

Referring to FIG. 2, in one embodiment, is an oral cleaning system 100 comprising an oral cleaning device 10 and a remote device 40 which is separate from the oral cleaning device. The oral cleaning device 10 can be any of the oral cleaning device embodiments disclosed or otherwise envisioned herein. For example, according to an embodiment, oral cleaning device 10 includes one or more sensors 28 and a controller 30 comprising a processor 32. The oral cleaning device 10 includes a drivetrain 22, the operation of which is controlled by controller 30. Oral cleaning device 10 also comprises a connectivity module 38. The connectivity module 38 transmits collected sensor information, including to remote device 40, and can be any module, device, or means capable of transmitting a wired or wireless signal, including but not limited to a Wi-Fi, Bluetooth, near field communication, and/or cellular module.

According to an embodiment, remote device 40 can be any device configured to or capable of receiving and processing sensor information transmitted from oral cleaning device 10. For example, remote device 40 may be a cleaning device holder or station, a smartphone device, a computer, a tablet, a server, or any other computerized device. According to an embodiment, remote device 40 includes a communications module 41 which can be any module, device, or means capable of receiving a wired or wireless signal, including but not limited to a Wi-Fi, Bluetooth, near field communication, and/or cellular module. Device 40 also includes a processor 42 which uses the received information from sensor 28 sent via connectivity module 38. According to an embodiment, device 40 includes memory 44 to store received sensor information, or any other information.

According to an embodiment, remote device 40 includes a user interface 46 configured to provide feedback to the user before, during, and/or after a primary cleaning session, and before, during, and/or after a secondary cleaning session. The user interface 46 can take many different forms, but is configured to provide information to a user. For example, the information can be read, viewed, heard, felt, and/or otherwise interpreted concerning where, when, and/or how to brush particular sections, segments, or areas of the interior of the mouth. According to an embodiment, the user interface 46 provides feedback to the user, such as a guided cleaning session, that includes information about where within the mouth to brush, timing, angles, pressure, and/or a variety of other brushing parameters or characteristics. Accordingly, the user interface may be a display that provides information to the user, a haptic mechanism that provides haptic feedback to the user, a speaker to provide sounds or words to the user, or any of a variety of other user interface mechanisms. According to an embodiment, processor 42 of remote device 40 receives information from sensor 28 of the oral cleaning device via the connectivity modules, assesses and analyzes that information, and provides information that can be displayed to the user via the user interface 46.

For example, oral cleaning device 10 can collect sensor information using sensor 28 and transmit that information locally via a Bluetooth connection to a smartphone device 40, where the sensor information is processed and/or stored. As another example, oral cleaning device 10 can collect sensor information using sensor 28 and transmit that information via a WiFi connection to the Internet where it is communicated to a remote server device 40. The remote server device 40 processes and/or stores the sensor information. A user may access that information directly or may receive reports, updates, or other information from the remote server device 40 or an associated device. According to an embodiment, the remote device 40 includes a user interface 46 configured to display instructions to the user during the cleaning session and/or "touch-up" session. The user interface 46 can take various forms, but will provide instructions to the user that can be read, viewed, heard, felt, and/or otherwise interpreted concerning where, when and how to brush particular sections, segments, or areas of the interior of the mouth. The processor 42 of remote device 40 processes the information received from the sensor(s) 28, assesses and analyzes that information, and provides information that can be displayed to the user via the user interface 46.

Figure 3:
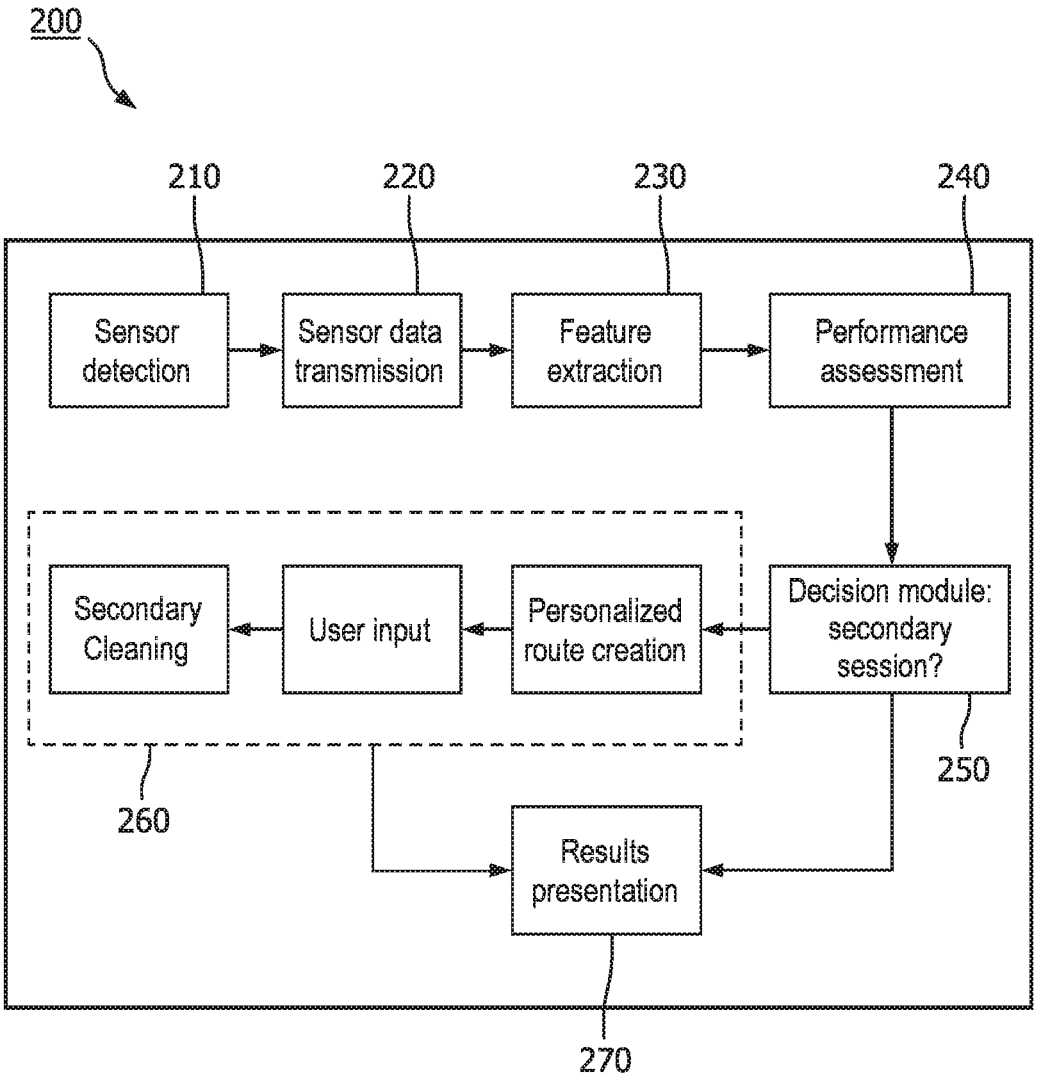
FIG. 3 is a schematic representation of an oral cleaning system, in accordance with an embodiment.

Referring to FIG. 3, in one embodiment, is an oral cleaning system 200 comprising an oral cleaning device 10. The oral cleaning device can be any of the oral cleaning device embodiments disclosed or otherwise envisioned herein. For example, according to an embodiment, oral cleaning device 10 includes one or more sensors 28 and a controller 30 comprising a processor 32. When utilized with electric cleaning devices, the oral cleaning device 10 includes a drivetrain 22, the operation of which is controlled by controller 30. System 200 also optionally comprises a remote device 40 which is separate from the oral cleaning device. Accordingly, oral cleaning device 10 can comprise a connectivity module 38 that transmits collected sensor information, including to remote device 40, and can be any module, device, or means capable of transmitting a wired or wireless signal, including but not limited to a Wi-Fi, Bluetooth, near field communication, and/or cellular module.

According to an embodiment of oral cleaning system 200, at sensor detection step or module 210, the sensor 28 of the oral cleaning device 10 obtains sensor data about a cleaning session. The obtained data is then optionally transmitted, via connectivity module 38, to remote device 40 at sensor data transmission step or module 220. In an embodiment without a remote device 40, the sensor data is utilized in downstream steps by the oral cleaning device 10.

A feature extraction module 230 receives data about the oral cleaning session from sensor 28, extracts the relevant information, and performs an assessment and/or analysis thereof. According to an embodiment, data including brushing coverage such as teeth areas cleaned, pressure coverage, and brushing duration is extracted from the data transmitted from sensor 28. Feature extraction module 230 can be configured to extract information about the orientation, angle, and/or location of the oral cleaning device from sensor 28, and can perform an analysis of the sensor data using any of a variety of analyze methods, including but not limited to a discrete cosine matrix method or a Kalman filter. That data can be compared, for example, to a predefined, predetermined, and/or personalized set of thresholds representative of the user's oral cavity.

According to another embodiment, feature extraction module 230 extracts the position of the oral cleaning device 10 by means of statistical analysis, such as by use of a Hidden Markov Model, which be pre-trained on a dedicated data set, can be user-specific based on data obtained during one or more training sessions, or can be a combination of both types of data. In yet another embodiment, sensor 28 is an electromagnetic sensor, and feature extraction module 230 extracts information regarding the proximity of a specific body part with respect to oral cleaning device 10. This can improve the accuracy of coverage measurements and can reduce ambiguity in orientation and/or position estimates. According to another embodiment, additional feature extraction can occur, including the detection of caries, demineralization, gingivitis, or other oral health conditions or traits. These conditions or traits can be extracted and/or identified using one or more dedicated sensing modalities, either embedded in the oral cleaning device 10, or a portion thereof. The spatial resolution of these features is provided by linking their detection with the extracted coverage information.

According to an embodiment of oral cleaning system 200, a performance assessment module 240 can analyze the extracted feature information. For example, the performance assessment module 240 can analyze the extracted feature information using a set of rules. These rules can be, for example, pre-defined or predetermined or can be personalized by or to the user or a dental care professional. According to an embodiment, the rules can be applied at a global scale, such as the entire mouth, or locally, such as a mouth segment or quadrant, or on the scale of individual teeth.

According to one embodiment, the rules are based on: (i) a required time spent in one or multiple part of a user's mouth, such as brushing every tooth surface located within a teeth segment for at least 20 seconds, brushing along the gum lines for a minimum of six seconds, and so on; and/or (ii) a required force applied in one or multiple locations within a user's mouth, such as a minimum force of 150 grams applied along the gum lines; and/or (iii) detection of an oral health condition, such as mild gingivitis detected in one or multiple interdental space. For example, Typical rules can, for example, identical or similar to Equations 1 and 2, although many other rules and equations are possible:

$$SegmentCoveragePerformance = 100 * \left[1 - \left(\frac{TimeSpentOnSegment}{TimeRequiredOnSegment}\right)\right] \quad \text{Eq. 1}$$

$$GingivitisPerfomance = 100 * [1 - (\Sigma GingivitisLevel)] \quad \text{Eq. 2}$$

The performance assessment module 240 can then provide the results of the analysis to user interface 46 through decision module: secondary session 250.

Figure 4:
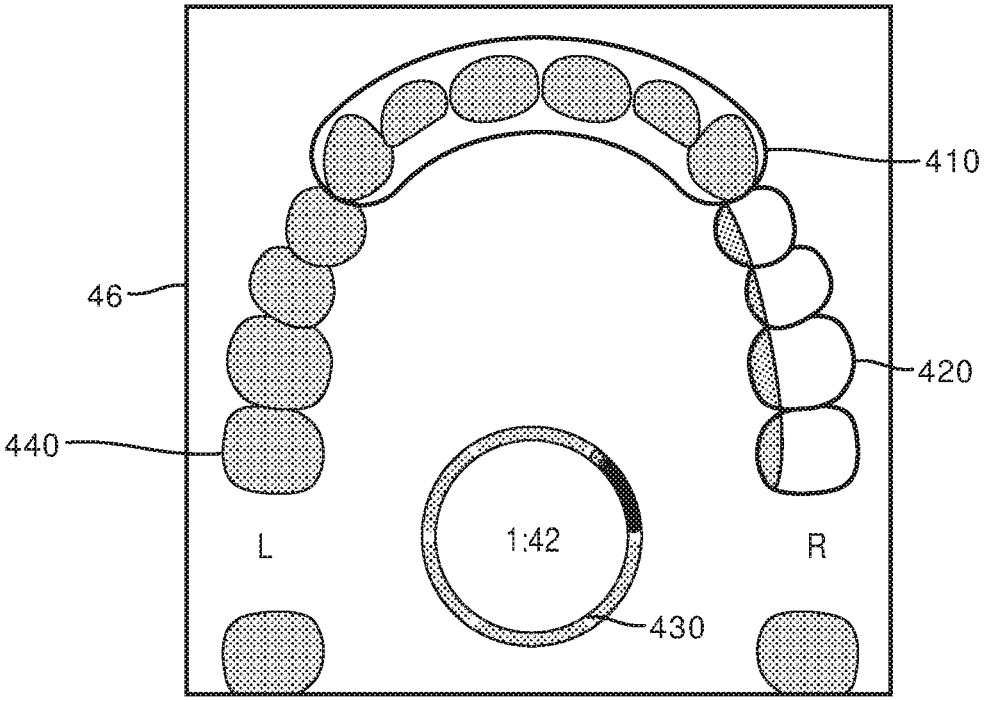
FIG. 4 is a graphical representation of a user interface of an oral cleaning system providing feedback to a user, in accordance with an embodiment.

Referring to FIG. 4, in one embodiment, is a schematic representation of user interface 46 of oral cleaning device 10 and/or remote device 40. The user interface comprises a depiction of the user's oral cavity, and includes information about areas 420 that have been cleaned during the current cleaning session, the area 410 currently being cleaned, and a clock 430 showing the total brushing time and/or remaining brushing time. The area(s) 440 still to be cleaned can also be depicted via user interface 46. Accordingly, the user interface can provide information and/or feedback to the user in real-time during the cleaning session.

Figure 5:
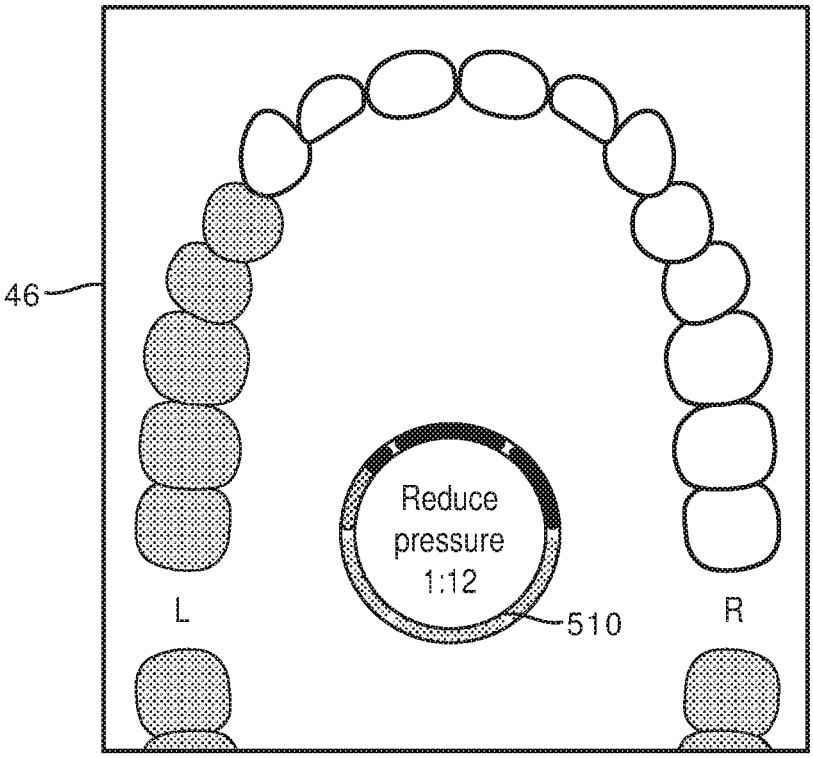
FIG. 5 is a graphical representation of a user interface of an oral cleaning system providing feedback to a user, in accordance with an embodiment.

Referring to FIG. 5, in one embodiment, is a schematic representation of user interface 46 of oral cleaning device 10 and/or remote device 40. The one or more sensors 28 include a pressure sensor and the system is utilizing that information to provide pressure feedback 510 about pressure being applied during the cleaning session. For example, if a user is applying too much pressure, feedback can be provided to user during the cleaning session informing the user to reduce the amount of pressure being applied to the brush. Similarly, if a user is applying too little pressure, feedback can be provided to user during the cleaning session informing the user to increase the amount of pressure being applied to the brush.

Figure 6:
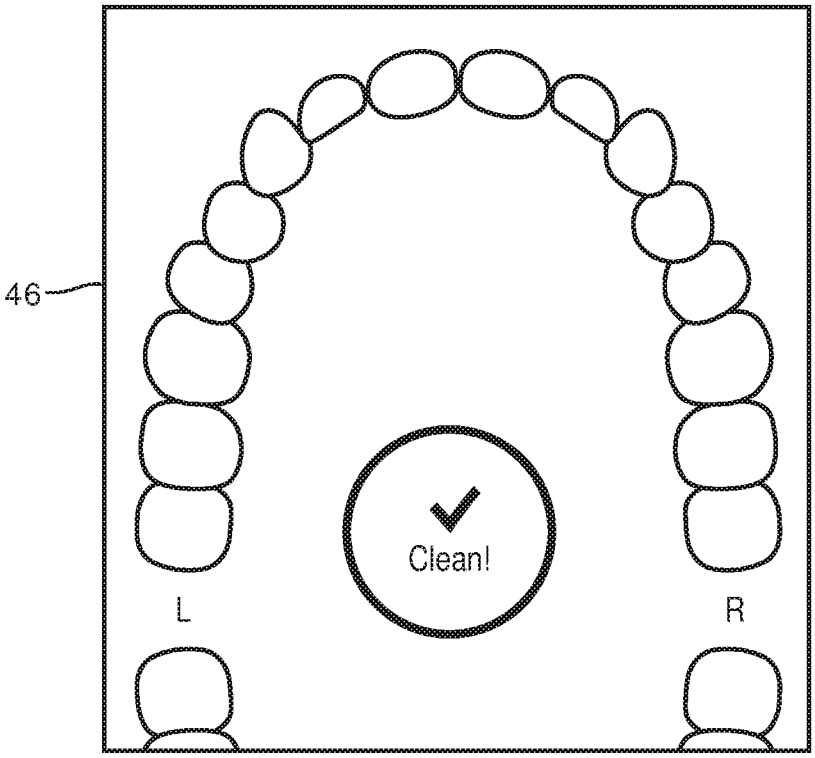
FIG. 6 is graphical representation of a user interface of an oral cleaning system providing feedback to a user regarding a successful cleaning session, in accordance with an embodiment.
Figure 7:
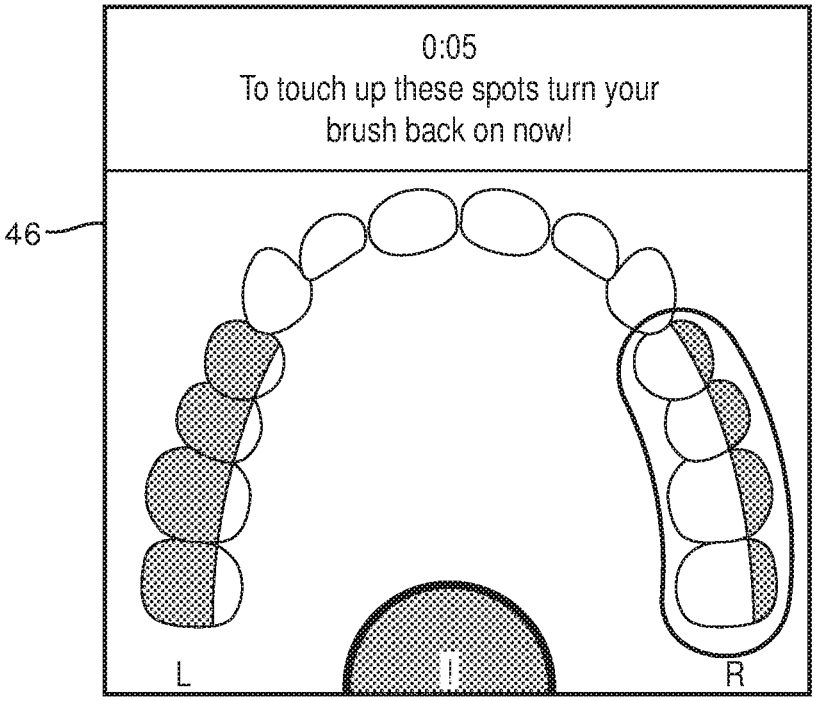
FIG. 7 is a graphical representation of a user interface of an oral cleaning system providing feedback to a user regarding the need for a subsequent cleaning session, in accordance with an embodiment.

Returning to FIG. 3, in one embodiment, decision module 250 receives information from performance assessment module 240 during the cleaning session. Decision module 250 is configured to analyze the information received from performance assessment module 240 in order to determine whether a secondary cleaning session is warranted or necessary. Accordingly, decision module 250 can: (1) provide feedback 270 to the user indicating that the primary cleaning session was adequate, as shown in FIG. 6; or (2) provide feedback to the user indicating that a secondary cleaning session is warranted or necessary, as shown in FIG. 7. As shown in FIG. 7, user interface 46 can provide information about secondary cleaning session, including but not limited to one or more areas to clean, and/or duration of additional cleaning.

Figure 8:
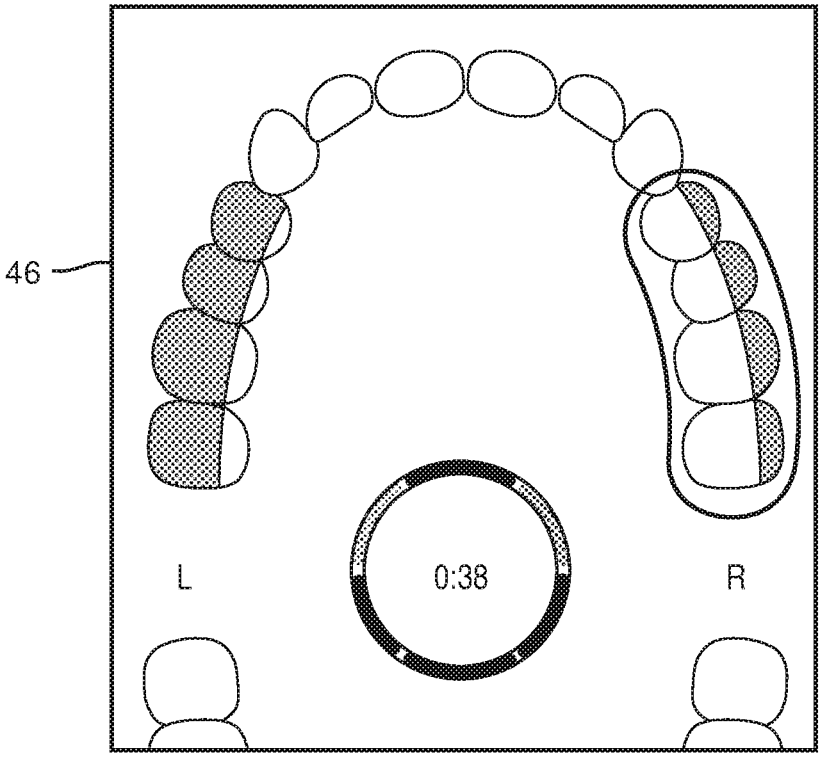
FIG. 8 is a graphical representation of a user interface of an oral cleaning system providing feedback to a user, in accordance with an embodiment.

According to an embodiment, if the user elects to perform the secondary cleaning session 260 oral cleaning device 10 is configured to perform one or more tasks related to that secondary cleaning session. For example, if too little force was used in a specific area during the primary cleaning session, the oral cleaning system 100, upon detecting that the oral cleaning device 10 is located in that portion of the oral cavity based on input from sensor 28, can implement an operating mode that applies greater pressure. When the oral cleaning system 100 detects that the oral cleaning device 10 has been moved away from that particular area of the oral cavity, the system can direct the oral cleaning device 10 to implement an operating mode that applies a standard amount of pressure, as brushing is being performed in an area where the user typically provides sufficient brushing pressure. Similarly, if too little time was spent cleaning a specific area, oral cleaning device 10 can provide information to the user, such as in FIG. 8, directing the user to clean a specific area for a determined interval in a secondary cleaning in order to achieve optimal cleaning in that area. When the indicated area has been cleaned for the necessary interval, the system can direct the user to another area of the oral cavity that requires additional brushing.

According to an embodiment, when the secondary cleaning session has been completed, decision module 250 can: (1) provide feedback to a user indicating that the secondary cleaning session was successful and the user's teeth are clean, as shown in FIG. 6; or (2) provide feedback to a user indicating that a subsequent cleaning session is necessary in order to focus on one or more areas still exhibiting low performance. The feedback can be presented to the user via user feedback 46, and the user can elect to perform the subsequent cleaning session, can decline the session, or can ignore the feedback, among other options.

Figure 9:
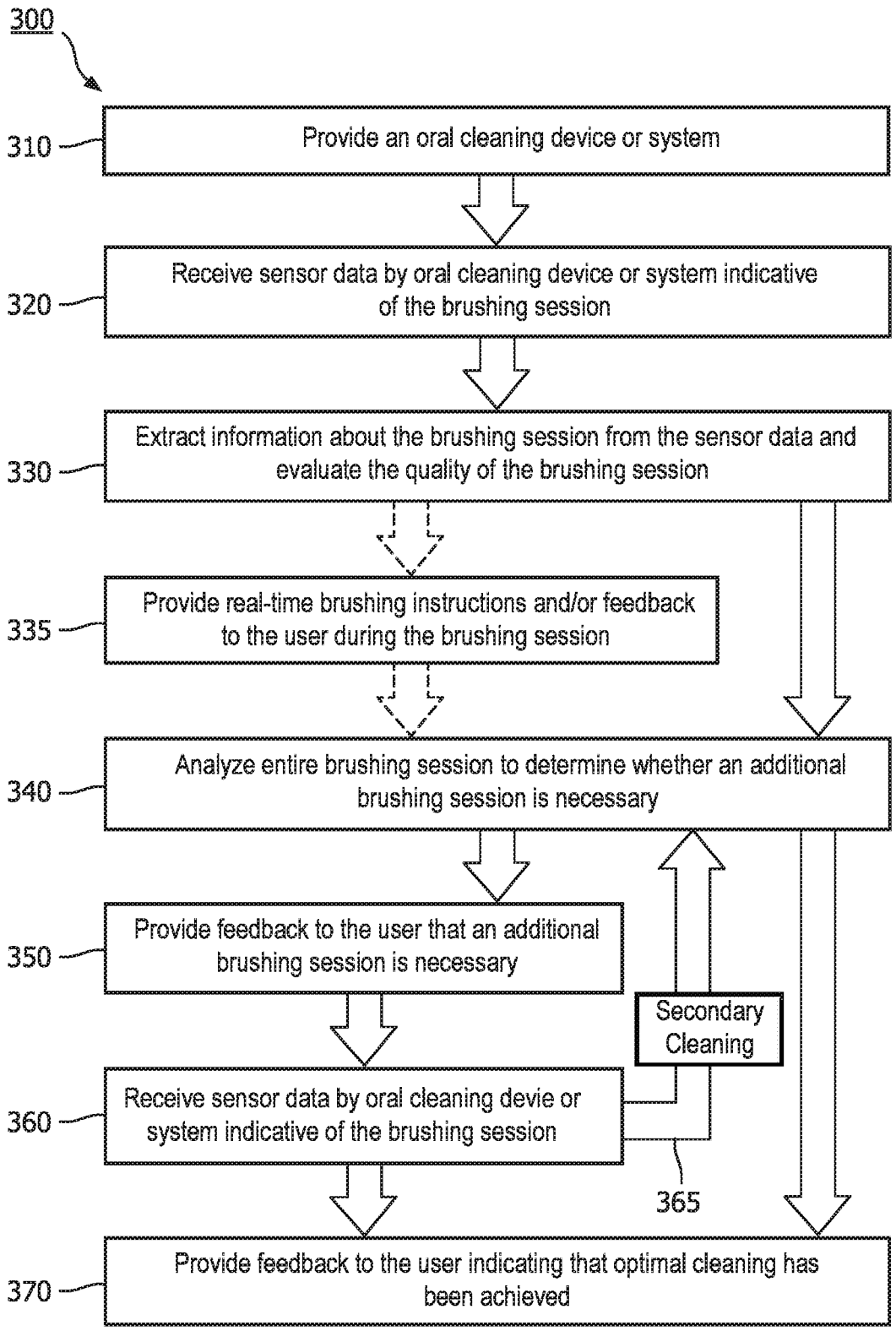
FIG. 9 is a flowchart of a method for providing feedback about a cleaning session to a user of an oral cleaning device, in accordance with an embodiment.

Referring to FIG. 9, in one embodiment, is a flowchart of a method 300 for providing feedback to a user of an oral cleaning device 10. In step 310, an oral cleaning device 10 or system 100, with oral cleaning device and remote device 40, is provided. The oral cleaning device can be any of the devices described or otherwise envisioned herein.

In step 320 of the method, the user engages in a cleaning session and the sensor 28 obtains data about the cleaning session, including but not limited to location of brushing, duration of brushing, and pressure of brushing. Device controller 30 receives the data from the sensor. According to an embodiment, device controller 30 transmits the data collected from sensor 28 to remote device 40 via connectivity module 38.

At step 330 of the method, device controller 30 and/or remote processor 42 analyzes the sensor data to extract and evaluate information about the user's cleaning session, as described above with regard to performance assessment module 240. For example, performance assessment module 240 can analyze the extracted information and evaluate the data using a set of rules. These rules can be, for example, pre-defined or predetermined or can be personalized by or to the user or a dental care professional. According to an embodiment, the rules can rules can be applied at a global scale, such as the entire mouth, or locally, such as a mouth segment or quadrant, or on the scale of individual teeth. For example, the rules can be based on: (i) a required time spent in one or multiple part of a user's mouth, such as brushing every tooth surface located within a teeth segment for at least 20 seconds, brushing along the gum lines for a minimum of six seconds, and so on; and/or (ii) a required force applied in one or multiple locations within a user's mouth, such as a minimum force of 150 grams applied along the gum lines; and/or (iii) detection of an oral health condition, such as mild gingivitis detected in one or multiple interdental space.

At optional step 335 of the method, during a cleaning session the oral cleaning device 10 and/or the remote device 40 provides instructions and/or feedback to the user during the cleaning session, such as shown in FIGS. 4, 5, and 6. As an initial step, the system directs the user to begin the cleaning session when the oral cleaning device 10 is turned on. Once the sensors 28 have determined the location of the oral cleaning device 10 in the user's mouth, the user interface 46 on oral cleaning device 10 and/or the remote device 40 can display a graphic representation of the user's mouth, and the mouth segment currently being cleaned, along with a timer showing the amount of time spent in the current segment, and total cleaning time. The user can use the timer to know how long to clean a particular segment or within a particular region. If a user does not clean in a particular segment for the proper time duration, the processor can determine this based on a change in location of the device 10 in the user's mouth, and the processor stores that information for use in step 340. If the user has brushed a particular mouth segment or area for the predetermined amount of time, in addition to displaying that information on the user interface 46, the system can also direct the user to switch to a different location within the user's mouth, either by commands on the user interface 46, by means of an audio signal, by means of haptic feedback, or by means of a combination of such signals. Additionally, the processor can analyze the data and provide real-time feedback to the user during the cleaning session. For example, if the oral cleaning device includes a pressure sensor, the performance assessment module can analyze the data extracted from the pressure sensor by feature extraction module, and determine whether the user is applying the proper amount of pressure while brushing. If not, feedback can be provided to the user via the user interface 46, such as is shown in FIG. 5.

At step 340 of the method, the oral cleaning device 10, system 100, and/or remote device 40 determines whether a supplemental cleaning session is needed. For example, device controller 30 and/or remote processor 42 can evaluate a portion or the entirety of a brushing session and can determine whether a supplemental cleaning session is needed. For example, as described herein, decision module 250, which may be device controller 30 and/or remote processor 42, a component of device controller 30 and/or remote processor 42, or software run with device controller 30 and/or remote processor 42, receives information from performance assessment module 240 during and/or after the cleaning session. Decision module 250 is configured to analyze the information received from performance assessment module 240 in order to determine whether a secondary cleaning session is warranted or necessary. Accordingly, decision module 250 can: (1) provide feedback 270 to the user indicating that the primary cleaning session was adequate, as shown in FIG. 6; or (2) provide feedback to the user indicating that a secondary cleaning session is warranted or necessary, as shown in FIG. 7.

For example, after a cleaning session is completed, the decision module 250 analyzes the received information and determines whether the user's actions have satisfied a predefined or predetermined threshold. If the user strictly adhered to guided brushing instructions, for example, it is expected that a secondary cleaning session will not be necessary. However, research has shown that most users do not clean for a full two-minute recommended session, do not brush all areas of the mouth for the recommended time duration, do not brush at the proper angle, and/or do not apply the appropriate pressure in all areas of the mouth, even with guided brushing instructions. Based on the analysis performed by decision module 106 of the current cleaning session from data received by the sensors 28, a determination of achieved optimal brushing performance can be made.

If the cleaning session executed by the user satisfies the predetermined threshold, then the method proceeds to step 370, and the user receives information via user interface 46 that the primary cleaning session was adequate, as shown in FIG. 6, and thus that a secondary cleaning session is not necessary.

If the cleaning session executed by the user fails to satisfy the predetermined threshold, then the method proceeds to step 350, and the user receives information via user interface 46 that the primary cleaning session was inadequate and thus that a secondary cleaning session is necessary. As shown in FIG. 7, for example, the indication to the user that a secondary cleaning session is necessary can include additional information, including but not limited to one or more areas to clean, and/or duration of additional cleaning. This personalized information about the secondary cleaning session can be, for example, focused on a specific area where low performance was detected (such as insufficient brushing time, improper brushing angle, insufficient brushing force, etc.), and can present the user the option of performing the secondary cleaning session. It should be appreciated, therefore, that the secondary cleaning session is customized based on performance in the immediately preceding cleaning session. As a result, a secondary cleaning session will typically vary from the preceding cleaning session.

Feedback generated by oral cleaning device 10, system 100, and/or remote device 40 can be provided to the user in any of a variety of different ways, including via visual, written, audible, haptic, or other types of feedback. For example, completion of a satisfactory brushing routine could be by means of audio, haptic or other signals, such as a positive signal or song.

At step 360 of the method, if the user elects to perform the secondary cleaning session 365 user interface 46 of the oral cleaning device 10 and/or remote device 40 can optically guide the user through secondary cleaning session 365 directing the user to areas needing additional cleaning, providing the user information on how long to perform additional cleaning in each area, and other information, and sensor 28 of the oral cleaning device will collect sensor data indicative of the cleaning session. For example, sensor 28 can obtain any of the data described herein, including but not limited to location of brushing, duration of brushing, and pressure of brushing. Device controller 30 receives the data from the sensor. According to an embodiment, device controller 30 transmits the data collected from sensor 28 to remote device 40 via connectivity module 38. The device controller 30 and/or remote processor 42 analyzes the sensor data to extract and evaluate information about the user's cleaning session, as described above with regard to performance assessment module 240.

At step 365 of the method, the system returns to step 340 and the oral cleaning device 10, system 100, and/or remote device 40 analyzes the sensor data received during the secondary cleaning session to determine whether a tertiary cleaning session is needed, using any of the methods described or otherwise envisioned herein. If a tertiary cleaning session is needed, the system proceeds to step 350. If the secondary cleaning session adequately resolved any issues, to the user receives feedback indicating that the secondary cleaning session was adequate, as shown in FIG. 6. According to an embodiment, the threshold for a secondary cleaning session is lower than the threshold for the primary cleaning session. And similarly, the threshold for a tertiary cleaning session may be even lower than the threshold for the secondary cleaning session.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for providing feedback to a user of an oral cleaning device, the method comprising the steps of:

receiving, from a sensor of the oral cleaning device, sensor data during a primary cleaning session;

extracting, from the received data, information about one or more parameters of the primary cleaning session and evaluating, based on the extracted information, the primary cleaning session;

determining, based on said evaluation, whether a secondary cleaning session is needed;

providing, via a user interface, an indication to the user that a secondary cleaning session is needed; and performing an operating mode of the oral cleaning device relating to the secondary cleaning session based on the one or more parameters of the primary cleaning session.

2. The method of claim 1, wherein the one or more parameters is selected from the group consisting of the duration of the primary cleaning session, pressure applied during the primary cleaning session, the location of the oral cleaning device within the mouth during the primary cleaning session, an angle of the oral cleaning device during the primary cleaning session, and combinations thereof.

3. The method of claim 1, wherein said determining step comprises the step of comparing the extracted information to a predetermined threshold.

4. The method of claim 1, wherein said evaluation comprises an analysis of the extracted information using a set of one or more rules.

5. The method of claim 1, wherein said indication comprises at least one of:

A. information about one or more segments of the user's mouth that requires additional cleaning during the secondary cleaning session, and B. an amount of additional cleaning time required for the one or more segments of the user's mouth that requires additional cleaning.

6. The method of claim 1, further comprising the step of providing real-time feedback about the cleaning session to the user during at least one of:

A. the primary cleaning session, and

B. the secondary cleaning session.

7. The method of claim 1, further comprising the step of receiving, from the sensor of the oral cleaning device, sensor data during the secondary cleaning session.

8. An oral cleaning device configured to provide feedback to a user about a cleaning session, the device comprising:

a sensor configured to obtain data regarding a brushing session;

a user interface configured to provide feedback to the user about the brushing session; and a controller in communication with the sensor and the user interface, wherein the controller is configured to: receive, from the sensor, sensor data during a primary cleaning session; extract, from the received data, information about one or more parameters of the primary cleaning session and evaluate, based on the extracted information, the primary cleaning session; determine, based on said evaluation, whether a secondary cleaning session is needed; provide, via the user interface, an indication to the user that a secondary cleaning session is needed; and perform an operating mode of the oral cleaning device relating to the secondary cleaning session based on the one or more parameters of the primary cleaning session.

9. The oral cleaning device of claim 8, wherein the sensor is one or more of a gyroscope, an accelerometer, and a magnetometer.

10. The oral cleaning device of claim 8, wherein the one or more parameters is selected from the group consisting of the duration of the primary cleaning session, pressure applied during the primary cleaning session, the location of the oral cleaning device within the mouth during the primary cleaning session, an angle of the oral cleaning device during the primary cleaning session, and combinations thereof.

11. The oral cleaning device of claim 8, wherein said indication comprises at least one of:

A. information about one or more segments of the user's mouth that requires additional cleaning during the secondary cleaning session, and B. an amount of additional cleaning time required for the one or more segments of the user's mouth that requires additional cleaning during the secondary cleaning session.

12. The oral cleaning device of claim 8, wherein the controller is further configured to perform at least one of:

A. provide real-time feedback about the cleaning session to the user during the primary cleaning session, and B. provide real-time feedback about the cleaning session to the user during the secondary cleaning session.

13. An oral cleaning system configured to provide feedback to a user about a cleaning session, the system comprising:

an oral cleaning device comprising a sensor configured to obtain sensor data regarding a brushing session, and a connectivity module configured to transmit the obtained sensor data; and a remote device comprising a communications module configured to receive the transmitted sensor data, and a processor configured to: extract, from the received data, information about one or more parameters of a primary cleaning session and evaluate, based on the extracted information, the primary cleaning session; determine, based on said evaluation, whether a secondary cleaning session is needed; provide an indication to the user that a secondary cleaning session is needed; and perform an operating mode of the oral cleaning device relating to the secondary cleaning session based on the one or more parameters of the primary cleaning session.

14. The oral cleaning system of claim 13, wherein the remote device comprises a user interface configured to provide said indication.

15. The oral cleaning system of claim 14, wherein the user interface is configured to provide real-time feedback about the cleaning session to the user during the cleaning session.

* * * * *